US008167135B2

(12) United States Patent
Nützel et al.

(10) Patent No.: US 8,167,135 B2
(45) Date of Patent: May 1, 2012

(54) APPARATUS AND METHOD FOR ACCEPTING OR DISPENSING BANK NOTES

(75) Inventors: Dominik Nützel, Munich (DE); Franz Reuter, Dorfen (DE); Xavier Thum, Wolfratshausen (DE)

(73) Assignee: Giesecke & Devrient GmbH, Munich (DE)

( * ) Notice: Subject to any disclaimer, the term of this patent is extended or adjusted under 35 U.S.C. 154(b) by 85 days.

(21) Appl. No.: 12/494,396

(22) Filed: Jun. 30, 2009

(65) Prior Publication Data

US 2010/0025308 A1 Feb. 4, 2010

Related U.S. Application Data

(60) Provisional application No. 61/091,906, filed on Aug. 26, 2008.

(30) Foreign Application Priority Data

Jun. 30, 2008 (DE) ..... 10 2008 030 878

(51) Int. Cl.
*B07C 5/00* (2006.01)
*G07F 7/04* (2006.01)

(52) U.S. Cl. ..... 209/534; 194/206; 902/13

(58) Field of Classification Search ..... 209/534; 194/206, 207; 902/12, 13
See application file for complete search history.

(56) References Cited

U.S. PATENT DOCUMENTS

| | | | | |
|---|---|---|---|---|
| 4,320,854 | A | 3/1982 | Hirose | |
| 4,564,122 | A * | 1/1986 | Granzow et al. | 221/12 |
| 4,616,817 | A * | 10/1986 | Yamauchi et al. | 271/111 |
| 4,733,765 | A * | 3/1988 | Watanabe | 194/206 |
| 4,980,543 | A * | 12/1990 | Hara et al. | 235/379 |
| 5,076,413 | A * | 12/1991 | Davila et al. | 194/206 |
| 5,971,131 | A * | 10/1999 | Blattner et al. | 198/357 |
| 6,164,638 | A | 12/2000 | Owens | |
| 7,708,192 | B2 * | 5/2010 | Yokoi et al. | 235/379 |
| 7,849,992 | B2 * | 12/2010 | Seo et al. | 194/206 |
| 2002/0092905 | A1 * | 7/2002 | Katou et al. | 235/379 |
| 2007/0034683 | A1 * | 2/2007 | Eastman et al. | 235/379 |
| 2009/0206541 | A1 * | 8/2009 | Nutzel et al. | 271/10.01 |

FOREIGN PATENT DOCUMENTS

| | | | |
|---|---|---|---|
| DE | 10203176 | A1 | 8/2003 |
| EP | 0499458 | A2 | 8/1992 |
| EP | 1926057 | A1 | 5/2008 |

OTHER PUBLICATIONS

Search Report of German Patent Office regarding German Patent Application 10 2008 030 878.1, May 18, 2009.
International Search Report in PCT/EP2009/004452, Sep. 21, 2009.

* cited by examiner

*Primary Examiner* — Joseph C Rodriguez
(74) *Attorney, Agent, or Firm* — Bacon & Thomas, PLLC

(57) ABSTRACT

The present invention relates to an apparatus and a method for accepting or dispensing or returning bank notes. An operator wishing to remove bank notes protruding from the apparatus for dispensing or returning, is assisted during removal in that the bank notes are transported towards the operator by the apparatus as soon as the operator grasps the bank notes and starts pulling or moving them out of the apparatus.

3 Claims, 2 Drawing Sheets

APPARATUS AND METHOD FOR ACCEPTING OR DISPENSING BANK NOTES

BACKGROUND OF THE INVENTION

A. Field

The present invention relates to an apparatus and a method for accepting or dispensing or returning bank notes.

B. Related Art

Apparatus for accepting or dispensing or returning bank notes are known. The known apparatus are based on the finding that a pocket which is used for inputting bank notes to be accepted is also used for returning bank notes which could not be accepted, e. g. because they could not be recognized or because malfunctions occurred during processing. Furthermore the pocket can be used for dispensing bank notes.

From DE 102 03 176 B4 furthermore such an apparatus for accepting or dispensing or returning bank notes is known in which a stack of loose bank notes is input in an opening of the apparatus or removed from the opening. The complete stack of bank notes is transported from or to this opening for further processing or removing the bank notes. A transport system is provided therefor, having an upper and a lower part, between which the stack of bank notes is clamped for transport, for which purpose for example the upper part of the transport system is moved toward the lower part of the transport system, on which the stack of bank notes rests. When dispensing or returning bank notes it is provided to transport the stack of bank notes for such a distance that the stack of bank notes protrudes from the opening, so that the bank notes can be grasped by an operator.

Since it is to be avoided while dispensing or returning bank notes that the bank notes drop out of the opening of the apparatus, the bank notes are usually transported for such a distance only that they protrude from the opening by less than half of their dimension. Moreover, the bank notes can continue to be clamped by the transport system to prevent them securely from dropping out unintentionally.

Through these measures for preventing the dropping out of the bank notes it is made more difficult for the operator to remove the bank notes from the apparatus when they protrude from the opening. The operator has to pull the bank notes out of the apparatus counteracting the clamping force of the transport system for a considerable distance. On the other hand, if the clamping is omitted, the bank notes can be removed more easily by the operator, but the risk that the bank notes drop out unintentionally increases.

SUMMARY OF THE DISCLOSURE

It is the object of the present invention to provide an apparatus and a method for accepting or dispensing or returning bank notes in which removing bank notes to be dispensed or returned is rendered easier, but which are secured specially against the bank notes dropping out unintentionally.

Therein the invention proceeds on the one hand from a method for accepting or dispensing or returning bank notes in which the bank notes to be accepted or dispensed or returned are transported from or to an input and output position or to or from a singling position, wherein the bank notes to be dispensed or returned are transported away from the input and output position by a predetermined distance and held, whereupon the transport of the bank notes to be dispensed or returned is stopped and it is monitored whether the bank notes are moved out of the apparatus, and the transport of the bank notes out of the apparatus is restarted, if the movement of the bank notes is detected during the monitoring.

Moreover, the invention proceeds from an apparatus for accepting or dispensing or returning bank notes with a transport system for transporting the bank notes to be accepted or dispensed or returned by the apparatus within a pocket, from or to an opening of the pocket to or from a singling device adjoining the pocket, with a clamping of the bank notes between a first part and a second part of the transport system for transport, as well as a control device for controlling the components of the apparatus, wherein bank notes to be dispensed or returned are transported out of the opening by the transport system by a predetermined distance, whereupon the control device stops the transport system and evaluates signals from a sensor in order to determine whether the bank notes are moved out of the apparatus, whereupon the control device restarts the transport system to transport the bank notes out of the apparatus.

It is a particular advantage of the invention that an operator wishing to remove the bank notes protruding from the apparatus is supported during the removal as soon as the operator grasps the bank notes and starts pulling or moving them out of the apparatus. In addition the unintentional dropping out of the bank notes is securely prevented by the clamping in the transport system.

Further advantages of the present invention will be evident from following description of an embodiment of the invention with reference to the figures.

DETAILED DESCRIPTION OF PREFERRED EMBODIMENTS OF THE INVENTION

Figure 1:
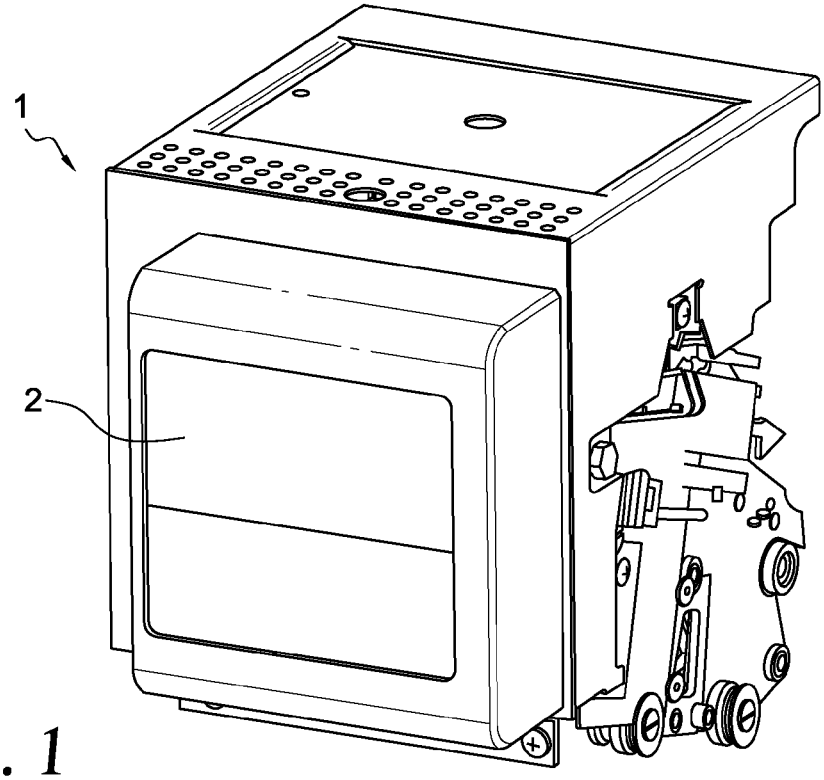
FIG. 1 shows an embodiment of an apparatus for accepting or dispensing or returning bank notes, with an opening closed by a faceplate.

In FIG. 1 an embodiment of an apparatus 1 for accepting or dispensing or returning bank notes is shown, with a pocket for accepting or dispensing or returning bank notes having an opening 2' as input and output position, which opening can be closed by a faceplate or a shield 2.

Figure 2:
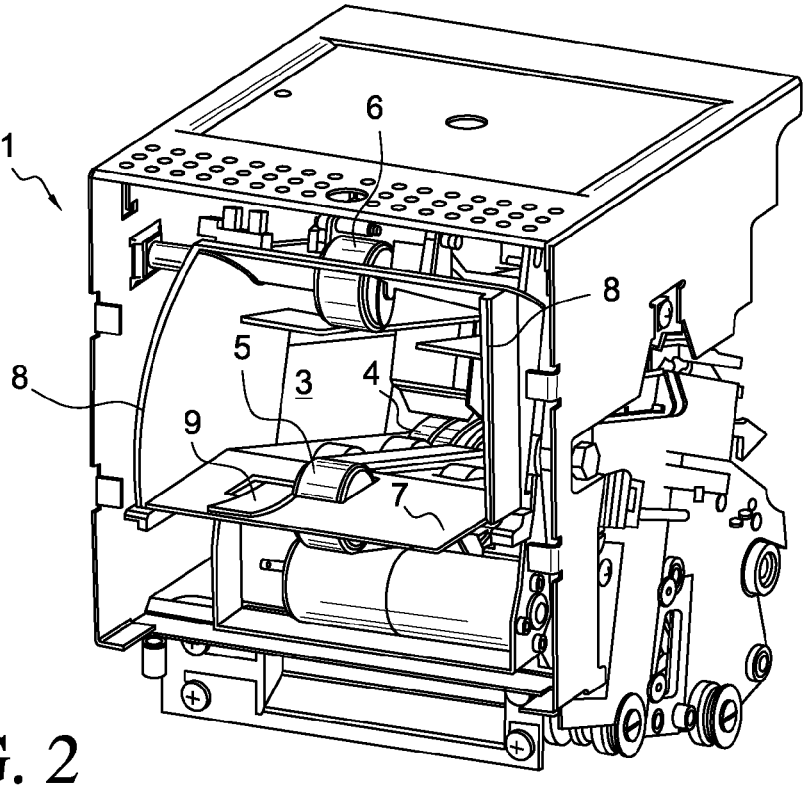
FIG. 2 shows the apparatus for accepting or dispensing or returning bank according to FIG. 1 without faceplate.

FIG. 2 shows the embodiment represented in FIG. 1 of the apparatus 1 for accepting or dispensing or returning bank notes, wherein the faceplate 2 was removed to reveal the pocket 3 for accepting or dispensing or returning bank notes. Therefore components 4 of a singling device for singling bank notes are visible. Additionally a transport system 5, 6 consisting of a first, upper part 6 and a second, lower part 5, is shown, whose function will be described in detail below. The transport system 5, 6 is in its initial position, in which the upper part 6 of the transport system 5, 6 is moved away from the lower part 5 by the maximum distance. The dimensioning of a distance thus formed between the upper and the lower part of the transport system 5, 6 essentially depends on a maximum amount of bank notes to be transported, i. e. the distance depends on the thickness of a stack formed by the bank notes to be accepted and/or dispensed or returned. In the shown embodiment the transport system is formed by belts. However, it is obvious that also a roller transport system or a transport system of a different structure can be used.

Figure 3:
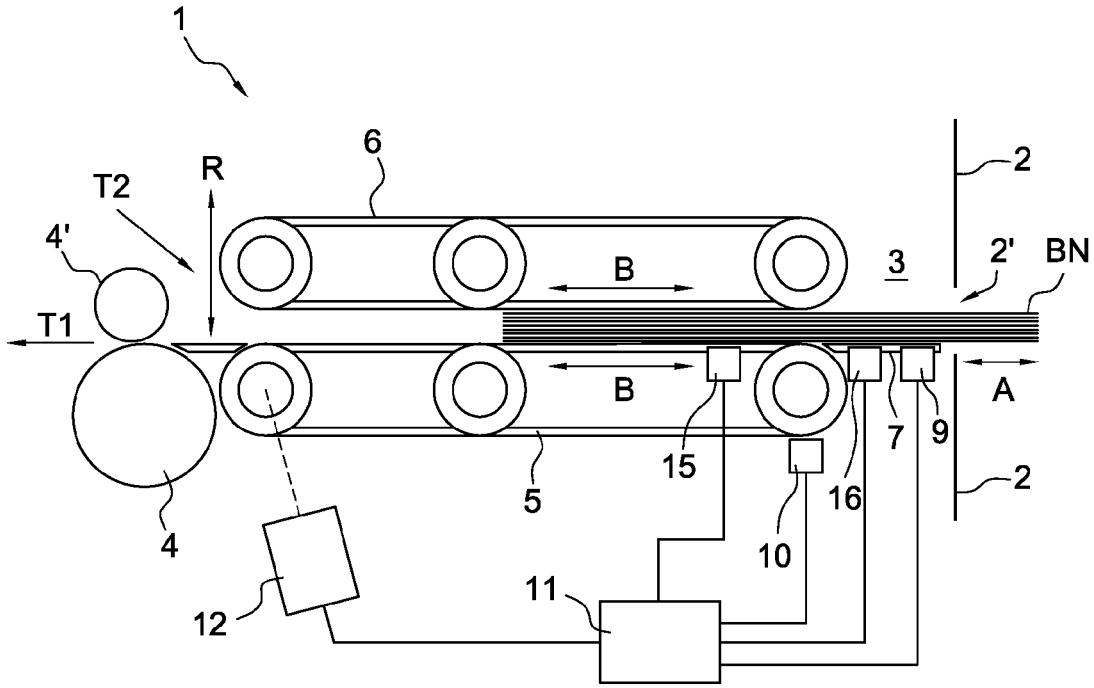
FIG. 3 shows a transport system arranged in the apparatus for accepting or dispensing or returning bank notes according to FIG. 1, for transporting stacked or single bank notes.

FIG. 3 shows the transport system 5, 6 of the apparatus 1 for accepting or dispensing or returning bank notes after bank notes BN have been input by an operator in the pocket 3 limited by the side walls 8 (see FIG. 2) and a rack 7. By the dimensioning of the faceplate 2 and of the components accommodating it (not shown), it is achieved that the bank notes BN cannot be input by the operator so that they reach the end of the pocket 3, i.e. the singling device 4, 4' consisting of a singling roller 4 and a retaining roller 4'. On the other hand, the bank notes BN can be input in the pocket 3 to such an extent that, after the operator lets go of them, they are safely accommodated in the pocket 3 and do not drop out. The dimensioning of the pocket 3, the faceplate 2 and of the components accommodating the faceplate 2 depends on the size of the bank notes to be input and should allow that the bank notes can be input in the pocket 3 up to more than half of the measured length of the long side of the largest bank note. Alternatively it can be provided that when the bank notes BN are input in the pocket 3 a sensor 9, e. g. a light barrier, detects the input of the bank notes BN, whereupon the transport system 5, 6, as described below, takes over and clamps the bank notes BN inside the pocket 3. It is thus on the one hand achieved that the bank notes BN cannot be input by the operator up to the singling device 4, 4'. On the other hand, the bank notes BN cannot drop out of the pocket 3 unintentionally.

After or during inputting the stack of bank notes BN the upper part of the transport system 6 is displaced along the traverse path R in the direction of the lower part 5 for example by means of a parallel drive, until the bank notes BN are clamped between the lower part 5 and the upper part 6. Therein the upper part 6 can be brought to a pre-tensioned position by means of a spring, so that the bank notes are held between the upper part 6 and the lower part 5 by a defined clamping force. As described above, the displacement of the upper part 6 can be controlled by evaluating a signal of the light barrier 9. However, also further sensors 15, 16, e. g. light barriers or light scanners, can be present. The upper part 6 of the transport system 5, 6 is then displaced in the direction of the lower part 5, when both the light barrier 15 and the light barrier 16 are covered by the bank notes BN. It is thus ensured that the bank notes BN are disposed within the range of the transport system 5, 6. For evaluating the signal of the light barriers 9, 15, 16 and controlling the transport system 5, 6 and further components of the apparatus 1 a control device 11 can be provided, for example a microcomputer.

After clamping the bank notes BN a first estimate of how many bank notes BN were input can be made on the basis of the position of the upper part 6 of the transport system 6, i.e. the number of bank notes BN to be accepted can be determined approximately. It is thus also possible to determine whether the maximum admissible amount of bank notes was exceeded, e. g. the input of more than 100 bank notes. In this case the acceptance procedure can be terminated and the operator can be requested to remove the bank notes BN and to input a smaller amount of bank notes.

When bank notes BN are accepted the bank notes BN clamped between the upper part 6 and the lower part 5 are transported into the pocket 3 by the transport system 5, 6. Expediently both parts 5, 6 of the transport system 5, 6 are actuated therein. However, it is also possible, as shown in FIG. 3, to actuate only one of the parts 5 or 6, e. g. the lower part 5 by means of a motor 12 controlled by the control device 11. The bank notes BN are transported into the pocket 3 completely, so that the faceplate 2 can be closed. After closing the faceplate 2 the upper part 6 of the transport system 5, 6 can be moved away from the bank notes BN or the clamping can be loosened at least and the bank notes BN can be singled by means of the singling device 4, 4' and transported in the direction T1 in the apparatus 1 for further processing.

Subsequently the input bank notes BN are processed, i. e. they are accepted. For this purpose the apparatus 1 for accepting and/or dispensing or returning bank notes is connected to a bank note processing device. The bank note processing device can for example have a transport system, a sensor device, a repository for bank notes, e. g. one or several cassettes for different types of bank notes, an intermediate repository for storing bank notes during processing, etc.

In case that errors occur during processing, the acceptance procedure can be aborted and it can be provided that the input bank notes BN are returned completely or partly to the operator. Likewise bank notes not recognized during processing, two or several bank notes picked at one time by the singling device 4, 4', etc. can be returned to the operator. For this purpose the bank notes to be returned BN are transported out of the apparatus 1 into the pocket 3 in the direction T2. To separate the bank notes to be returned from the not yet singled input bank notes, a dividing element can be provided. Also bank notes which are to be dispensed and come e.g. from the above-mentioned cassettes of the apparatus 1 are transported into the pocket 3 in the direction T2. The upper part 6 of the transport system 5, 6 therein is for example disposed in its initial position, to make space in the pocket 3 for the bank notes to be dispensed or returned.

Once all bank notes to be dispensed or returned are in the pocket 3, the upper part of the transport system 5, 6 is displaced along the traverse path R against the bank notes BN until they are clamped. Afterwards the bank notes BN are transported by the transport system 5, 6 in the direction of the faceplate 2 and the faceplate 2 is opened. The stack of bank notes BN is transported by the transport device 5, 6 until the bank notes BN protrude from the opening formed by the faceplate 2 by such a distance (length A) that the operator can grasp and remove the bank notes BN. The transport of the bank notes out of the opening is for example controlled by the control device 11 evaluating the signals from the light barrier 9. After the front edge of the bank notes 9 was detected by the light barrier 9 the motor 12 or the drive of the transport system 5, 6 is continued to be run for a certain time which is determined by the transport speed of the transport system 5, 6 and the predetermined length A, by which the bank notes BN are to protrude from the faceplate 2.

If the bank notes BN are grasped and pulled out of the apparatus by the operator, a sensor 10, e. g. a clock-pulse generator which is expediently provided with a rotation direction detection, detects the movement of the stack of bank notes BN by the operator. Such a clock-pulse generator can for example have an encoder disk resting on a shaft of the transport system and having a transmitter and receiver for detecting code marks. For the purpose of detecting the rotation direction the encoder disk has two different code mark systems which are detected by the transmitter and receiver upon the rotation of the encoder disk. By evaluating the signals from the receiver, e. g. in the control device 11, the rotation and the direction of the rotation is recognized.

To make removing the bank notes BN from the apparatus 1 easier the transport system 5, 6 clamping the stack of bank notes BN can have a play B. Expediently the play B can be adjusted in such a fashion that the stack of bank notes BN can be moved for such a distance that at least a certain, predetermined number of code marks can be detected by the transmitter and receiver of the clock-pulse generator 10. As soon as the control device 11 recognizes on the basis of the signals of the clock-pulse generator 10 that the bank notes BN are grasped by the operator and pulled out of the apparatus 1, i.e. the predetermined number of code marks was counted, the control device 11 starts the drive or motor 12 of the transport system 5, 6 in order to transport the stack of bank notes BN out of the apparatus 1 and to thus support the operator.

The drive or motor 12 can be switched off by the control device 11, e.g. after the evaluation of the signal of the light barrier 9 has the result that the hind edge of the stack of bank notes BN has passed the light barrier 9. Finally the control device 11 can furthermore prompt the upper part 6 of the transport system 5, 6 to be moved back to its initial position, for example to enable the further inputting of bank notes BN. To control the drive or motor 12 also the signals of the clock-pulse generator 10 can be evaluated by the control device 11. For example the drive 12 can be switched off after a certain number of clock pulses by the clock-pulse generator 12, which corresponds to the length A by which the bank notes BN protrude from the opening formed by the faceplate 2.

The above-described play B of the transport system 5, 6 can furthermore be held in a stop position via a restoring force, e.g. a return spring. When the operator stops pulling at the bank notes BN, the restoring force becomes effective. Thereby it can be determined by the control device 11 that the operator does no longer pull at the bank notes BN. The control device 11 can then stop the drive or the motor 12 of the transport system 5, 6, so that these are not transported completely out of the clamping of the transport system 5, 6 and drop out of the opening formed by the faceplate 2. During the dispensing of the bank notes supported by the drive or motor 12 the control device 11 can check continuously whether the operator continues pulling at the bank notes, in order to prevent the above-described unintentional dropping out of the bank notes BN.

For the case that the operator forgets to remove the bank notes to be dispensed or returned BN from the pocket 3, e.g. 20 seconds after they were presented to the operator, the bank notes to be returned BN are transported back into the pocket 3 by the transport system 5, 6 controlled by the control device 11, and the faceplate 2 is closed. Subsequently the bank notes to be dispensed or returned BN are singled and kept in the bank note processing device connected to the apparatus 1 for accepting or dispensing or returning bank notes; e.g. in one of the cassettes described above or in a special container for forgotten bank notes.

Instead of the embodiment shown and described so far, in which the bank notes are transported parallel to their long edges, it is of course also possible to transport them parallel to their short edges. In this case of course all components of the apparatus 1 for accepting and/or dispensing or returning bank notes have to be dimensioned accordingly.

Likewise, it is possible that instead of a stack of bank notes also individual bank notes are accepted and/or dispensed or returned by means of the apparatus.

Furthermore in addition to bank notes to be accepted or to be dispensed also checks, vouchers or other documents of value can be contained. These are processed together with the bank notes or separately, and are for example kept in a special cassette of the repository of the bank note processing device connected to the apparatus 1 for accepting or dispensing or returning bank notes.

In the event that disturbances occur during the singling of bank notes BN by means of the singling device 4, 4', the transport system 5, 6 can also be used to eliminate these disturbances. In particular bank notes which are wedged in the gap of the singling device 4, 4' can be pulled out by means of the transport system 5, 6, provided that the wedged bank note still protrudes into the pocket 3 far enough that it can be collected by the transport system 5, 6. The wedged bank note and possibly further bank notes still disposed in the pocket 3 are then transported in the direction of the faceplate 2 and the wedged bank note is freed during the transport into the pocket 3. The further bank notes disposed in the pocket 3 can abut on the faceplate 2 during this procedure, whereby they are deformed. After freeing the wedged bank note the transport direction of the transport system 5, 6 is reversed and the further bank notes are transported back to their original position. Alternatively or additionally also the upper part 6 can be moved away from the bank notes, so that the deformed further bank notes move back to their original position due to the deformation.

In the event that more considerable disturbances occur, the upper part 6 and/or the above-mentioned dividing element can be brought to their initial position, so that the space of the pocket 3 is completely open and offers the operator or a service person access to the singling device 4, 4'.

The invention claimed is:

1. An apparatus for accepting or dispensing or returning bank notes, comprising a transport system arranged to transport bank notes to be accepted or dispensed or returned by the apparatus within a pocket, from or to an opening of the pocket to or from a singling device adjoining the pocket, including a device that clamps the bank notes between a first part and a second part of the transport system for transport, as well as a control device controlling the components of the apparatus, wherein the transport system includes a play, said transport system arranged to transport or return bank notes to be dispensed or returned out of the opening by a predetermined length and to hold the bank notes, whereupon the control device is arranged to stop the transport system and evaluate signals from a sensor to determine whether the bank notes are being removed from the apparatus, whereupon, if such removal is sensed, the control device is arranged to restart the transport system to transport the bank notes out of the apparatus, wherein the play includes a device to exert a restoring force that is activated as soon as the bank notes are no longer being removed from the apparatus, and the control device is arranged to check continuously during the transport of the bank notes out of the apparatus as to whether the restoring force is activated, and to stop the transport system if the restoring force is activated.

2. The apparatus according to claim 1, wherein the sensor comprises a clock-pulse generator connected with the transport system.

3. The apparatus according to claim 1, including a further sensor, which is arranged to determine whether the bank notes were removed from the pocket, whereupon the control device is arranged to stop the restarted transport system again.

* * * * *